US009182203B2

(12) United States Patent
Mirza

(10) Patent No.: US 9,182,203 B2
(45) Date of Patent: Nov. 10, 2015

(54) FIREARM CARTRIDGE PRIMER REMOVAL TOOLS

(71) Applicant: Iurie Mirza, Ridgefield, WA (US)

(72) Inventor: Iurie Mirza, Ridgefield, WA (US)

( * ) Notice: Subject to any disclaimer, the term of this patent is extended or adjusted under 35 U.S.C. 154(b) by 0 days.

(21) Appl. No.: 14/592,740

(22) Filed: Jan. 8, 2015

(65) Prior Publication Data

US 2015/0198429 A1 Jul. 16, 2015

Related U.S. Application Data

(60) Provisional application No. 61/926,032, filed on Jan. 10, 2014.

(51) Int. Cl.
*F42B 33/04* (2006.01)
*F42B 33/10* (2006.01)

(52) U.S. Cl.
CPC ..... *F42B 33/04* (2013.01)

(58) Field of Classification Search
CPC ..... F42B 33/00; F42B 33/04; F42B 33/06; F42B 33/10
USPC ..... 86/31, 32, 33, 36, 37
See application file for complete search history.

(56) References Cited

U.S. PATENT DOCUMENTS

| | | | | | |
|---|---|---|---|---|---|
| 242,775 | A * | 6/1881 | Hobbs | 86/36 |
| 351,861 | A * | 11/1886 | Greenough | 86/23 |
| 506,425 | A * | 10/1893 | Elliott | 86/31 |
| 600,613 | A * | 3/1898 | Handshy | 86/31 |
| 716,797 | A * | 12/1902 | Wesson | 86/36 |
| 937,604 | A * | 10/1909 | Hodge | 86/36 |
| 2,748,648 | A * | 6/1956 | Miller | 86/36 |
| 3,097,560 | A * | 7/1963 | Ponsness | 86/27 |
| 3,157,086 | A * | 11/1964 | Bachhuber | 86/27 |
| 3,313,201 | A * | 4/1967 | Lawrence | 86/32 |
| 3,693,497 | A * | 9/1972 | Jacobitz | 86/28 |
| 3,982,465 | A * | 9/1976 | Schabauer | 86/36 |
| 4,027,781 | A * | 6/1977 | Covert | 221/105 |
| 4,078,472 | A * | 3/1978 | Simpson | 86/23 |
| 4,188,855 | A * | 2/1980 | Alberts | 86/36 |
| 4,228,724 | A * | 10/1980 | Leich | 86/26 |
| 4,549,463 | A * | 10/1985 | Raiha | 86/36 |
| 4,593,598 | A * | 6/1986 | Gunder | 86/36 |
| 4,615,255 | A * | 10/1986 | Carter | 86/27 |
| 4,640,724 | A * | 2/1987 | Carter et al. | 149/109.6 |
| 5,204,488 | A * | 4/1993 | Cimolino et al. | 86/32 |
| 5,221,806 | A * | 6/1993 | Chaney et al. | 86/19 |
| 6,772,668 | B2 * | 8/2004 | Shields | 86/31 |
| 2004/0025677 | A1 * | 2/2004 | Koch et al. | 86/24 |

* cited by examiner

*Primary Examiner* — Bret Hayes
*Assistant Examiner* — Derrick Morgan
(74) *Attorney, Agent, or Firm* — DASCENZO Intellectual Property Law, P.C.

(57) ABSTRACT

Firearm cartridge primer removal tools include a base configured to support a plurality of spent firearm cartridge casings, and a plurality of primer removal pins supported relative to the base and configured to be operatively translated toward and into engagement with, and to remove, primers from spent firearm cartridge casings supported by the base.

19 Claims, 2 Drawing Sheets

FIREARM CARTRIDGE PRIMER REMOVAL TOOLS

RELATED APPLICATION

This application claims priority under 35 U.S.C. §119(e) to U.S. Provisional Patent Application No. 61/926,032, entitled "FIREARM CARTRIDGE PRIMER REMOVAL TOOLS," which was filed on Jan. 10, 2014, and the complete disclosure of which is hereby incorporated by reference.

FIELD

The present disclosure relates to the removal of primers from firearm cartridges.

SUMMARY

Firearm cartridge primer removal tools include a base configured to support a plurality of spent firearm cartridge casings, and a plurality of primer removal pins supported relative to the base. The pins are configured to be operatively translated toward and into engagement with, and to remove, primers of the spent firearm cartridge casings supported by the base. Some tools further include at least one tray configured to receive a plurality of spent firearm cartridge casings and configured to be selectively positioned relative to the base for operative alignment of the spent firearm cartridge casings with the plurality of primer removal pins. Some tools include more than one tray sized for different calibers of firearm casings. Some tools include or are configured to be operatively used with a press.

DESCRIPTION

Figure 1:
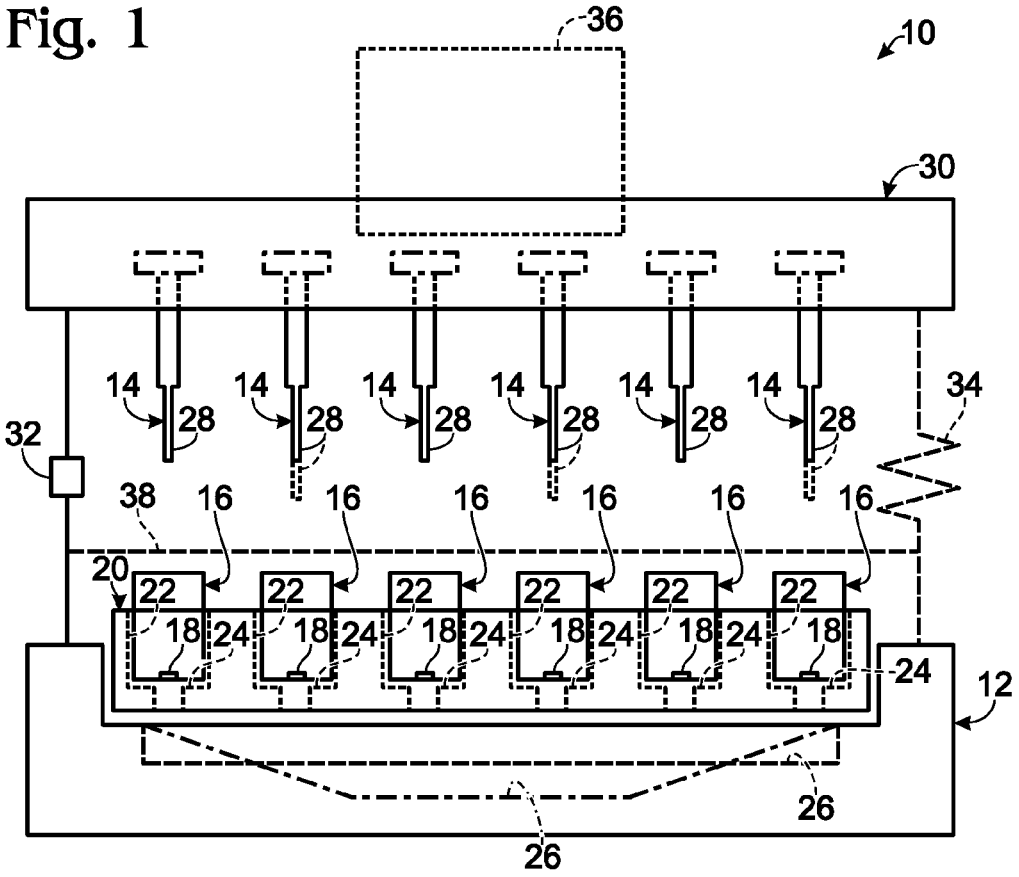
FIG. 1 is a schematic diagram representing firearm cartridge primer removal tools according to the present disclosure, together with a plurality of firearm cartridge casings having primers to be removed.
Figure 2:
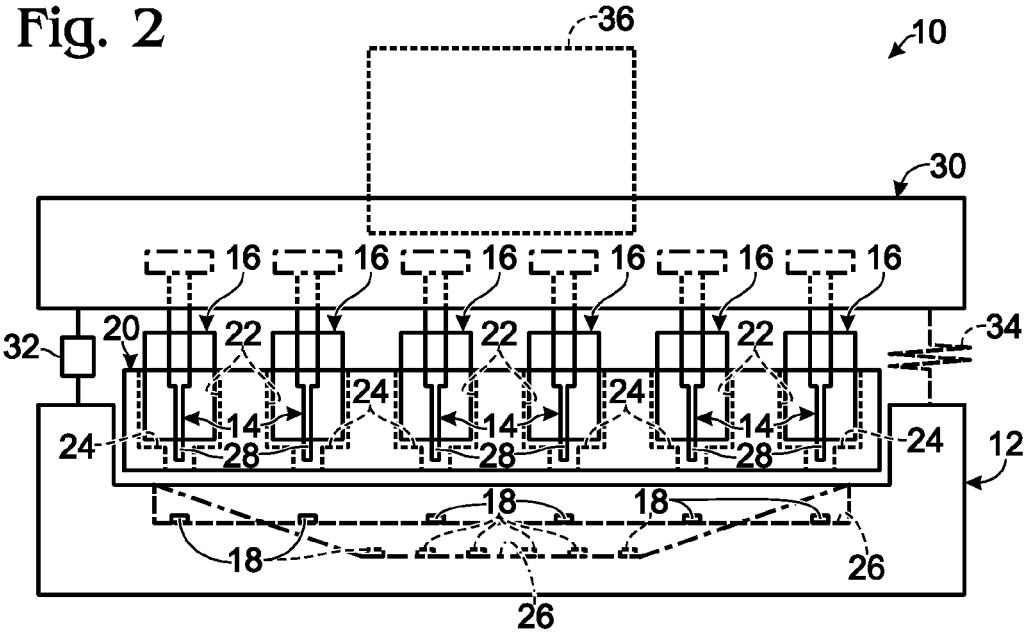
FIG. 2 is another schematic diagram representing firearm cartridge primer removal tools according to the present disclosure, with the apparatus represented in a configuration having removed primers from a plurality of firearm cartridge casings.

Firearm cartridge primer removal tools according to the present disclosure are schematically represented in FIGS. 1-2 and are indicated generally at 10. In general, in FIGS. 1-2, elements that are likely to be included in a given example are illustrated in solid lines, while elements that are optional to a given example are illustrated in broken lines. However, elements that are illustrated in solid lines are not essential to all examples of the present disclosure, and an element shown in solid lines may be omitted from a particular example without departing from the scope of the present disclosure.

Firearm cartridge primer removal tools 10 additionally or alternatively may be described herein as tools for removing firearm cartridge primers or simply as tools 10. As schematically illustrated, tools 10 include at least a base 12 and a plurality of primer removal pins 14 that are supported relative to the base. The base is configured to support a plurality of spent (i.e., previously discharged and/or previously fired) firearm cartridge casings 16, and the primer removal pins are configured to be operatively translated toward and into engagement with, and to remove, primers 18 from spent firearm cartridge casings that are supported by the base. In FIG. 1, the primer removal pins 14 are schematically illustrated spaced away from and above the spent casings and the primers to be removed, and in FIG. 2, the primer removal pins are schematically illustrated as having been operatively translated toward, into engagement with, and subsequently having removed the primers from, the spent casings.

Tools 10 may be configured to remove primers from casings of any suitable type of cartridge, including (but not limited to) centerfire cartridges, rifle cartridges, pistol cartridges, and shotgun shells. Additionally or alternatively, tools 10 may be configured to remove any suitable type of primer, including (but not limited to) Boxer primers and shotgun primers.

FIGS. 1-2 schematically illustrate six primer removal pins and six corresponding casings with primers to be removed; however, tools 10 may be configured for removal of any suitable number of primers including two or more at a given time.

As schematically illustrated in FIGS. 1-2, some embodiments of tools 10 also include at least one tray 20 that is configured to receive a plurality of spent firearm cartridge casings, with the tray being configured to be selectively positioned relative to the base 12 for operative alignment of casings and their primers to be removed with the plurality of primer removal pins 14. Additionally or alternatively, the base may be described as being configured to operatively receive a tray 20 so that primers of spent firearm cartridge casings that are received by the tray are operatively aligned with the plurality of primer removal pins. Additionally or alternatively, in some embodiments, the base 12 may include and/or may be a tray 20.

In FIGS. 1-2, the casings 16 are schematically illustrated in an overlapping relationship with the optional tray 20, schematically representing that in embodiments that include a tray, the tray may be configured for operative support of a plurality of casings in any suitable manner. That is, any suitable configuration of tray may accomplish this function. As an illustrative, non-exclusive example, and as schematically and optionally illustrated in FIGS. 1-2 in dashed lines, a tray 20 may define a plurality of bores 22 that are sized to securely receive a plurality of spent firearm cartridge casings, with each bore being aligned with a longitudinal axis of a corresponding primer removal pin 14. Stated differently, the relative orientation of bores 22 corresponds to and/or is complementary to the relative orientation of pins 14. In some such examples, each bore has an upper depth with a first diameter corresponding to an outer diameter of a spent firearm cartridge casing to be supported by the tray and a lower depth with a second diameter that is smaller than the first diameter and greater than a diameter of an associated primer to be removed from a firearm cartridge casing. Accordingly, as schematically illustrated in FIG. 1, each bore may define a shoulder 24 that supports a casing with its primer to be removed being positioned directly over the lower depth of the bore. As a result, when the primer removal pins are operatively translated downward and into engagement with the primers, continued downward translation of the primer removal pins will operatively force the primers downward, separating them from the casings into the lower depth of the bore, as schematically illustrated in FIG. 2.

In some such examples, although not required in all such embodiments, the lower depths of the bores may extend completely through the tray and/or base, so that the removed primers fall through the lower depths and exit the tray and/or base under gravity. However, it also is within the scope of a tool 10 for the bores to be closed on a lower side thereof, thereby collecting individual removed primers within the bores. Under these conditions, the primers may be removed from the bores by turning over the tray and/or base for the primers to exit the bores under gravity.

Bores 22 may have any suitable shape, such that they are sized to operatively receive and hold in place corresponding casings 16 with corresponding different outer diameters. For example, bores 22, or at least upper depths thereof, may have circular cross-sectional profiles. Alternatively, bores, 22, or at least upper depths thereof, may have non-circular cross-sections, such as polygonal cross-sectional profiles.

Some tools 10 may include more than one tray, with the trays being configured for different calibers of casings. For example, a first tray may be provided that is configured to receive a plurality of spent firearm casings of a first caliber, and a second tray may be provided that is configured to receive a plurality of spent firearm casings of a second caliber that is different from the first caliber. Moreover, a tray may be provided that is configured to receive a plurality of spent firearm casings of a third caliber that is different from the first and second calibers. Any number of trays may be provided in connection with a tool 10, including one, two, three, four, or more than four trays for any number of different calibers of casings.

Additionally or alternatively, a tray 20 may be configured to operatively receive and appropriately position relative to the primer removal tools more than one caliber of casings. Illustrative, non-exclusive examples of calibers of casings for which one or more trays may be configured for operative receipt, include (but are not limited to) calibers in the range of 5-13 millimeters (mm), including such common calibers as 0.223 inch (in.) (5.56 mm), 0.357 in. (9 mm), 0.4 in. (10.16 mm) (0.40 S&W), 0.452 in. (11.5 mm) (0.45 ACP), and 0.308 in. (7.8 mm). Calibers outside of this range, as well as other calibers within this range, are within the scope of the present disclosure.

In some examples, the primer removal pins 14 are fixed relative to each other. As a result, the associated tray or trays are configured for operative alignment of the casings with the primer removal pins regardless of the caliber of casings. In other examples, the primer removal pins 14 and a tray 20 may be configured to facilitate adjustment of the positioning of the pins and the bores, for example, to properly align them with each other depending on the caliber of casings from which the primers are to be removed.

As schematically and optionally illustrated in dashed lines in FIGS. 1-2, some tools 10 include a base 12 that defines a primer receipt region 26, which additionally or alternatively may be described as a primer collection region 26. When provided, the primer receipt region is positioned to receive primers that have been operatively removed from spent firearm cartridge casings by the primer removal pins. For example, in examples of tools that include a tray 20 that is separate from the base 12, the primer receipt region may be positioned directly below the tray when the tray is operatively supported on the base. Accordingly, when a tray includes bores 22 that extend fully through the tray and that are open to the bottom of the tray, the primers will fall into the primer receipt region when the primer removal pins force them from the spent casings.

In some such examples, as schematically and optionally illustrated in FIGS. 1-2 in dash-dot lines, an optional primer receipt region 26 may be shaped to funnel, or otherwise direct, removed primers in a desired direction relative to the casings from which they were removed. For example, a primer receipt region may be shaped so that the primers roll, or otherwise translate under gravity, away from the base 12, such as to be collected by a user or by a separate collection bin. Additionally or alternatively, the primer receipt region may be shaped so that the primers roll, or otherwise translate under gravity, toward each other, such as to facilitate a user to more easily collect all of the removed primers from the primer receipt region.

As schematically illustrated in FIGS. 1-2, the primer removal pins may be described as each including a distal tip, or end, 28 that is configured to operatively engage primers from spent firearm cartridge casings that are supported by the base 12, such as by an optional tray 20. Typically, the distal tips of the pins will have a cross-sectional area that is less than or equal to a cross-sectional area of the flash hole above the primer opening, or pocket, within a casing that is sized to receive and retain a primer. Additionally or alternatively, the distal tip of a pin may be sized to be received within the casing's primer flash hole without operatively engaging the casing itself. The distal tips may be circular or any other suitable shape. Additionally or alternatively, the distal tips may be pointed, rounded, or otherwise tapered. However, when utilizing a tool 10 with casings that do not include flash holes, such as associated with shotgun shells, the distal tips of the pins will have a cross-sectional area that is less than or equal to a cross-sectional area of the primer itself.

In some embodiments, the distal tips are unevenly spaced relative to the base, as schematically illustrated in dashed lines in FIGS. 1-2 with a subset of the pins having distal tips spaced closer to the base. As an illustrative, non-exclusive example, a first subset of pins may have distal tips that are spaced a first distance away from the base, and a second subset of pins may have distal tips that are spaced a second distance away from the base, with the second distance being different from the first distance. Any number of subsets of pins having distal tips with differing positions may be incorporated into a tool 10, including tools with more than two subsets of pins. As an illustrative, non-exclusive example, tools with a greater number of pins may have a greater number of subsets of pins than tools with a fewer number of pins. Moreover, the number of subsets of pins having differing positions of distal tips may be selected to result in a desired force required to remove the primers from casings supported by the base. For example, a tool 10 having a base and/or a tray that is configured to operatively support fifty spent casings optionally may have more subsets of pins having differing positions of distal tips than a tool 10 having a base and/or a tray that is configured to operatively support ten spent casings. Similarly, a tool 10 having a base and/or a tray that is configured to operatively support one hundred spent casings optionally may have more subsets of pins having differing positions of distal ends than a tool 10 having a base and/or a tray that is configured to operatively support fifty spent casings. Additionally or alternatively, the number of desired subsets of pins having distal tips of differing positions may be selected based on the caliber or calibers of casings to be operated on by a tool 10. For example, larger calibers of casings may require a greater force to remove a primer, and therefore it may be desirable to have a greater number of subsets of pins with distal tips of differing positions for removal of a given number of primers of larger caliber casings than the same given number of primers of smaller caliber casings. Additionally or alternatively, different types of casings may require a greater force to remove a primer, for example, casings associated with some military-style cartridges that utilize crimped primer pockets.

While FIGS. 1-2 schematically illustrate a single row of pins 14 and corresponding casings 16, tools 10 may include pins that are spaced in two dimensions and a base and/or tray that similarly is configured to support casings spaced apart in two dimensions. As mentioned, tools 10 may be configured for removal of any suitable number of primers, including two or more at a given time. Accordingly, any suitable number of pins 14 may be included in a tool 10. As illustrative, non-exclusive examples, a tool 10 may include at least two, at least ten, at least twenty-five, at least fifty, 2-100, 10-100, 25-100, 50-100, 2-50, 10-50, 25-50, 2-25, 10-25, and/or 2-10 primer removal pins, with the base 12 and/or optional tray 20 of such a tool being configured to support a corresponding number of casings 16.

Tools 10 may be configured in any suitable manner to facilitate the operative removal of primers from spent casings 16. For example, as schematically illustrated in FIGS. 1-2, a tool 10 may include an upper frame member 30 that operatively supports the plurality of primer removal pins 14, for example, with the upper frame member being configured to be selectively translated toward and away from the base 12, thereby operatively translating the pins 14 toward and away from the base for operative removal of pins associated with a plurality of casings supported by the base. In some embodiments, the pins 14 may be integral to the upper frame member 30. Alternatively, as optionally and schematically represented in FIGS. 1-2 in broken lines, the pins may be separate from the upper frame member, with the upper frame member being configured to operatively receive and position the pins in appropriate positions for operative removal of primers. In some such embodiments, the pins may be configured to be removable and replaceable from the upper frame member, for example, if a pin were to break. As schematically illustrated in dash-dot lines in FIGS. 1-2, the pins optionally may include a T-shaped upper end that retains the pin under gravity within the upper frame member, such as under a removable cover; however, any suitable structure for removable and replaceable pins may be utilized, including (but not limited to) threaded pins and tapped upper frame members.

In some embodiments, as schematically illustrated in FIGS. 1-2, a tool 10 may include a support frame 32 that operatively couples the upper frame 30 to the base and supports the upper frame relative to the base for functional operation of the tool. In some such embodiments, the support frame 32 may be configured for and/or may facilitate operative adjustment of the upper frame 30 relative to the base 12. For example, some embodiments of tools 10 may be configured to be adjusted depending on the size of caliber of cartridge casing, and more specifically depending on the length of cartridge casing, for which the removal of primers is facilitated using a tool 10. For example, the support frame 32 may have at least two configurations, with a first configuration being configured to facilitate typical handgun calibers and with a second configuration being configured to facilitate typical rifle calibers.

In some embodiments, the upper frame member may be biased away from the base. For example, a tool 10 may include one or more springs 34, or other biasing structures, that operatively bias the upper frame member away from the base, as optionally and schematically illustrated in FIGS. 1-2.

Additionally or alternatively, as optionally and schematically represented in FIGS. 1-2, a tool 10 may include an actuator 36 that is configured to operatively translate the plurality of primer removal pins 14 toward the base for operative removal of primers from spent firearm cartridge casings supported by the base. As an illustrative, non-exclusive example, the actuator may include and/or be a press, such as an arbor press. Additionally or alternatively, the actuator may be one or more of hydraulic, pneumatic, mechanical, electrical, and/or electro-mechanical. Additionally or alternatively, the actuator may be configured to be manually operated. Additionally or alternatively, the actuator may be free of hydraulic, pneumatic, electrical, and/or electro-mechanical components. Additionally or alternatively, the actuator may include one or more of a lever, cams, and/or gears to provide a mechanical advantage for manual operation of the actuator, for example, with the actuator being configured to be operated with an input of less than fifty, less than twenty-five, less than ten, or less than five pounds (lbs) from a user. Additionally or alternatively, a tool 10 may be configured to be operated without a separate actuator, such as with a user manually engaging and translating the upper frame member 30 to operatively translate the pins 14 into engagement with primers to be removed from casings that are operatively supported by the base. Additionally or alternatively, the optional upper frame 30 may be described as an actuator 36, with the upper frame being configured to operatively receive a downward force from a user, such as by the user pressing down with his/her hand on the upper frame.

As schematically and optionally illustrated in dashed lines in FIG. 1, some tools 10 further include a casing retention structure 38 that is positioned above the casings 16 when supported by the base 12 and/or a tray 20 and below the pins 14 when the pins are retracted and spaced away from the casings. The optional casing retention structure is configured to permit the pins to translate at least partially through the casing retention structure during operation of the tool 10. However, the optional casing retention structure is configured to not permit the casings to translate through the casing retention structure. For example, depending on the tolerance between the distal tips of the pins and the primers to be removed from the spent cartridge casings and/or between the distal tips of the pins and the primer openings of the casings, a casing may frictionally stick, or otherwise become coupled to, a pin during operation of the tool. Then when the pins are retracted away from the base, one or more casings may translate together with the pins. The optional casing retention structure, when present, provides a barrier for the casings to engage, so that the casings will be prevented from continuing an upward translation with the pins following removal of the primers. Illustrative, non-exclusive examples of optional casing retention structures include meshes, nets, grids, plates with bores, etc. having passages that are aligned with the longitudinal axes of the pins and with solid material that prevents the casings from passing through such passages.

Tools 10 and various component parts of tools 10 may be constructed of any suitable material or materials. As illustrative, non-exclusive examples, one or more of the base 12, the pins 14, the optional tray 20, the optional upper frame member 30, and/or the optional support frame 32 may be constructed of metal, such as steel or aluminum. Additionally or alternatively, the optional tray 20 may be constructed of a polymer. Tools 10 and various component parts may be constructed in any suitable manner, including one or more of machining, molding, 3-D printing, stamping, casting, etc.

Figure 3:
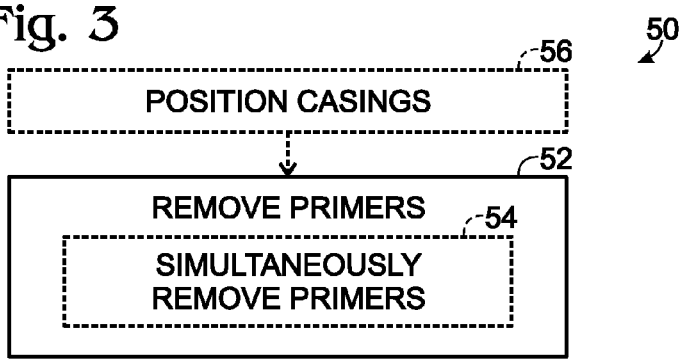
FIG. 3 is a flowchart schematically representing methods of removing primers from spent firearm cartridge casings according to the present disclosure.

Methods of removing primers from spent firearm cartridge casings according to the present disclosure are schematically represented in FIG. 3 and are indicated generally at 50. A method 50 may (but is not required to) be performed utilizing a tool 10 according to the present disclosure. Stated differently, a tool 10 may be configured to perform and/or facilitate a method 50; however, methods 50 are not required to be performed by and/or facilitated by a tool 10.

As schematically illustrated in FIG. 3 at 52, a method 50 may include a step of operatively removing primers from more than one spent firearm cartridge casing in response to a single user action. In some such methods, the operatively removing step 52 may include simultaneous removal of primers from more than one spent casing in response to a single user action, as schematically and optionally indicated at 54 in FIG. 3. For example, in connection with a tool 10 that includes a set of more than one pin 14 having distal ends that are evenly spaced relative to the base 12, a single user action may result in multiple primers being removed simultaneously. Also within the scope of the present disclosure, however, are methods 50 in which a single user action results in non-simultaneous removal of more than one primer, such as in connection with tools 10 having at least two pins that are not similarly spaced away from the base 12. Additionally or alternatively, a step 52 may include simultaneous removal of a first set of primers at a first moment in time and simultaneous removal of a second set of primers at a second and later moment in time, both as the result of a single user action. Illustrative, non-exclusive examples of a single user action include operations of an actuator 36 of a tool 10, which may include the pulling of a lever, the pressing of a button, the cranking of a crank, etc.

Additionally, as optionally and schematically represented in FIG. 3 at 56, a method 50 may include a step of positioning spent firearm cartridge casings prior to removing 52 the primers therefrom. For example, in connection with tools 10, a tray 20 that supports one or more spent firearm cartridge casings may be positioned relative to the primer removal pins 14 of a tool 10.

Figure 4:
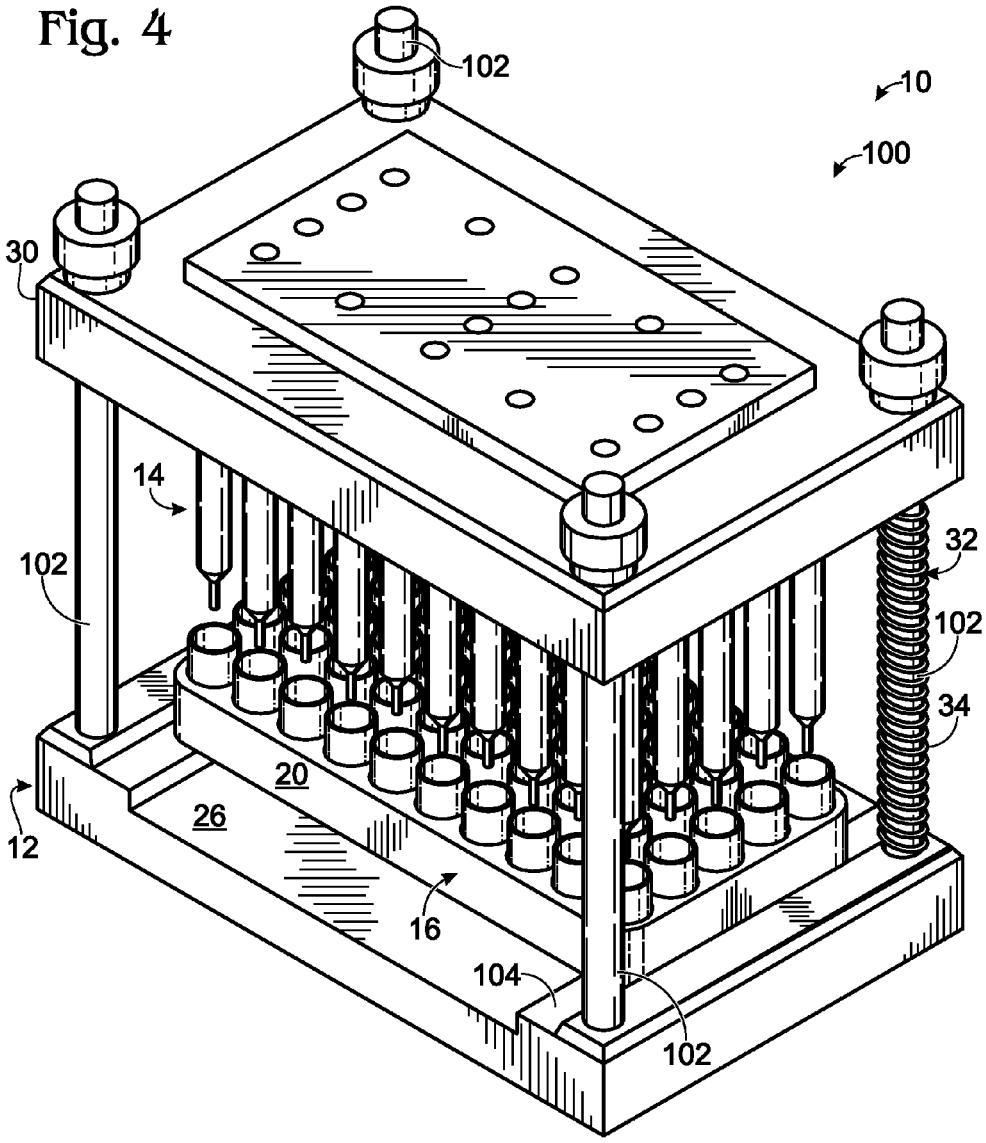
FIG. 4 is a perspective view of an illustrative, non-exclusive example of a firearm cartridge primer removal tool according to the present disclosure.

Turning now to FIG. 4, an illustrative non-exclusive example of a tool 10 and component parts thereof are illustrated, with the example tool being indicated at 100 and referred to herein as a tool 100. Where appropriate, the reference numerals from the schematic illustrations of FIGS. 1-2 are used to designate corresponding parts of tool 100; however, the example of FIG. 4 is non-exclusive and does not limit tools 10 to the illustrated embodiment of tool 100. That is, tools 10 are not limited to the specific embodiments of tool 100, and tools 10 may incorporate any number of the various aspects, configurations, characteristics, properties, etc. of tools that are illustrated in and discussed with reference to the schematic representations of FIGS. 1-2 and/or the embodiment of tool 100 in FIG. 4, as well as variations thereof, without requiring the inclusion of all such aspects, configurations, characteristics, properties, etc. For the purpose of brevity, each previously discussed component, part, portion, aspect, region, etc. or variants thereof may not be discussed, illustrated, and/or labeled again with respect to tool 100; however, it is within the scope of the present disclosure that the previously discussed features, variants, etc. may be utilized with these examples.

As seen with reference to FIG. 4, tool 100 is an example of a tool 10 that includes a base 12, fifty primer removal pins 14, an upper frame member 30, and a support frame 32 that operatively couples the upper frame to the base. The base of tool 100 defines a primer receipt region 26 and is configured to operatively support a tray 20 that is configured to receive fifty spent firearm cartridge casings 16.

The support frame 32 includes four columns, or posts, 102 that provide a frame for operative linear translation of the upper frame member 30, together with the primer removal pins 14, relative to the base 12. Additionally, tool 100 includes a spring 34, in the form of a coil spring around one of the posts 102. Accordingly, the spring 34 biases the upper frame, together with the primer removal pins 14, upward and away from the base.

The fifty primer removal pins of tool 100 are arranged in two dimensions with five rows of ten pins. Additionally, tool 100 is an example of a tool 10 in which the distal ends of the primer removal pins are unevenly spaced relative to the base. More specifically, tool 100 includes a first subset of pins that are spaced a first distance away from the base and a second subset of pins that are spaced a second, greater distance away from the base. In this example, the pins alternate along the rows and columns of pins, so that no two laterally adjacent pins have distal ends with the same position relative to the base; however, other configurations are within the scope of the present disclosure, and tool 100 may be configured with more than two subsets of pins having differing positions relative to the base or with a single set of pins all spaced evenly relative to the base.

The base of tool 100 is configured to operatively support trays 20 that are configured to operatively receive fifty spent firearm cartridge casings. More specifically, the base of tool 100 defines a ledge 104 that permits selective placement of a tray 20 thereon and that operatively aligns the spent firearm cartridge casings with the primer removal pins when the tray is appropriately supported by the base. The base of tool 100 also defines a primer receipt region 26 that is generally planar for collection of primers removed from spent cartridge casings held by the tray.

The spacings of the pins of tool 100 permit for primer removal from multiple calibers of spent firearm cartridge casings. For example, the spacings of the pins 100 permit for distinct trays 20 to be provided with different sizes of bores 22. As illustrative, non-exclusive examples, a first tray 20 may be configured to operatively receive 0.45 in. caliber casings, and a second tray 20 may be configured to operatively receive 9 mm caliber casings; however, other configurations of trays for other caliber casings also may be provided and used with tool 100.

Tool 100 may include and/or or be used with an arbor press or other type of press, in which case the tool would be positioned for operative engagement of the upper frame member 30 by the press. Accordingly, a user may position a tray of spent firearm cartridge casings operatively on the base of the tool and then operate the arbor press to linearly translate the upper frame, together with the primer removal pins, downward so that the pins operatively engage and push out the primers from the spent casings. The removed primers will fall onto the primer receipt region of the base for subsequent removal by a user.

Additionally or alternatively, tool 100 may be operated by hand, with a user simply applying a downward force on the upper frame to first overcome the spring force and then to operatively push out the primers from the spent casings.

Illustrative, non-exclusive examples of inventive subject matter according to the present disclosure are described in the following enumerated paragraphs:

A. A firearm cartridge primer removal tool, comprising:

a base configured to support a plurality of spent firearm cartridge casings; and a plurality of primer removal pins supported relative to the base and configured to be operatively translated toward and into engagement with and to remove primers from spent firearm cartridge casings supported by the base.

A1. The tool of paragraph A, further comprising:

at least one tray configured to receive a plurality of spent firearm cartridge casings, wherein the at least one tray is configured to be selectively positioned relative to the base for operative alignment of spent firearm cartridge casings received by the tray with the plurality of primer removal pins.

A1.1. The tool of paragraph A1, wherein the at least one tray includes a first tray configured to receive a plurality of spent firearm casings of a first caliber and a second tray configured to receive a plurality of spent firearm casings of a second caliber that is different from the first caliber, and optionally a third or more trays configured to receive a plurality of spent firearm casings of a third or more calibers that are different from the first and second calibers.

A1.1.1. The tool of paragraph A1.1, wherein the plurality of primer removal pins are fixed relative to each other and are configured to operatively remove primers from spent firearm cartridge casings supported by the first tray positioned relative to the base and to operatively remove primers from spent firearm cartridge casings supported by the second tray positioned relative to the base.

A1.2. The tool of any of paragraphs A1-A1.1.1, wherein the at least one tray is configured to receive spent firearm cartridge casings of more than one caliber.

A1.3. The tool of any of paragraphs A1-A1.2, wherein the base is configured to operatively receive the at least one tray so that primers of spent firearm cartridge casings received by the at least one tray are operatively aligned with the plurality of primer removal pins.

A1.4. The tool of any of paragraphs A1-A1.3, wherein the at least one tray defines a plurality of bores sized to securely receive a plurality of spent firearm cartridge casings, wherein each bore has a longitudinal axis generally aligned with a longitudinal axis of a corresponding primer removal pin of the plurality of primer removal pins when the tray is operatively positioned relative to the base.

A1.4.1. The tool of paragraph A1.4, wherein each bore has an upper depth with a first diameter corresponding to an outer diameter of a firearm cartridge casing and a lower depth with a second diameter that is smaller than the first diameter and greater than a diameter of an associated primer to be removed from the firearm cartridge casing.

A2. The tool of any of paragraphs A-A1.4.1, wherein the base defines a primer receipt region positioned to receive primers from spent firearm cartridge casings removed by the plurality of primer removal pins.

A2.1. The tool of paragraph A2 when depending from paragraph A1, wherein the base is configured to selectively receive the at least one tray operatively above the primer receipt region.

A3. The tool of any of paragraphs A-A2.1, wherein the plurality of primer removal pins are fixed relative to each other.

A4. The tool of any of paragraphs A-A3, wherein the plurality of primer removal pins each include a distal tip configured to operatively engage primers from spent firearm cartridge casings supported by the base, and wherein the distal tips are unevenly spaced relative to the base.

A4.1. The tool of paragraph A4, wherein the plurality of primer removal pins includes at least a first subset with distal tips spaced a first distance away from the base and a second subset with distal tips spaced a second distance away from the base, wherein the second distance is different from the first distance.

A4.1.1. The tool of paragraph A4.1, wherein the plurality of primer removal pins includes more than two subsets with distal tips spaced at different distances away from the base.

A5. The tool of any of paragraphs A-A4.1.1, wherein the plurality of primer removal pins are spaced apart in two dimensions.

A6. The tool of any of paragraphs A-A5, wherein the plurality of primer removal pins includes at least 2, at least 10, at least 25, at least 50, 2-100, 10-100, 25-100, 50-100, 2-50, 10-50, 25-50, 2-25, 10-25, and/or 2-10 primer removal pins.

A7. The tool of any of paragraphs A-A6, further comprising:

an upper frame member, wherein the upper frame member operatively supports the plurality of primer removal pins.

A7.1. The tool of paragraph A7, wherein the upper frame member is configured to be selectively translated toward and away from the base.

A7.2. The tool of any of paragraphs A7-A7.1, further comprising:

a support frame that operatively couples the upper frame member to the base.

A7.3. The tool of any of paragraphs A7-A7.2, wherein the upper frame member is biased away from the base.

A7.3.1. The tool of paragraph A7.3, further comprising:

a spring that operatively biases the upper frame member away from the base.

A8. The tool of any of paragraphs A-A7.3.1, further comprising:

an actuator configured to operatively translate the plurality of primer removal pins toward the base for operative removal of primers from spent firearm cartridge casings supported by the base responsive to a single user action.

A8.1. The tool of paragraph A8, wherein the actuator includes a press.

A8.2. The tool of any of paragraphs A8-A8.1, wherein the actuator is one or more of hydraulic, pneumatic, mechanical, electrical, and/or electro-mechanical.

A8.3. The tool of any of paragraphs A8-A8.2, wherein the actuator is configured to be manually operated.

A8.4. The tool of any of paragraphs A8-A8.3, wherein the actuator is free of hydraulic, pneumatic, electrical, and/or electro-mechanical components.

A8.5. The tool of any of paragraphs A8-A8.4, wherein the actuator includes one or more of a lever and/or gears to provide a mechanical advantage for manual operation of the actuator.

A8.6. The tool of any of paragraphs A8-A8.5, wherein the actuator is configured to be operated with an input of less than 50, less than 25, less than 10, or less than 5 lbs of force from a user.

A9. The tool of any of paragraphs A-A8.6, wherein the plurality of primer removal pins are configured to remove primers from spent firearm cartridge casings of more than one caliber.

A10. The tool of any of paragraphs A-A9, wherein the plurality of primer removal pins are spring-biased away from the base.

A11. The tool of any of paragraphs A-A10, further comprising:

a casing retention structure positioned above the base, wherein the casing retention structure is configured to permit the plurality of primer removal pins to pass through the casing retention structure while preventing spent firearm cartridge casings from passing through the casing retention structure.

A11.1. The tool of paragraph A11, wherein the casing retention structure includes one or more of a mesh, a net, a grid, and/or a plate with bores having passages aligned with longitudinal axes of the plurality of primer removal pins.

B. A method of removing primers from spent firearm cartridge casings, the method comprising:

operatively removing primers from more than one spent firearm cartridge casing in response to a single user action.

B1. The method of paragraph B, wherein the operatively removing includes simultaneously operatively removing primers from more than one spent firearm cartridge casing in response to the single user action.

B2. The method of any of paragraphs B-B1, further comprising:

prior to the operatively removing, positioning spent firearm cartridge casings.

B3. The method of any of paragraphs B-B2, wherein the method is performed utilizing the tool of any of paragraphs A-A11.1.

As used herein, the terms "selective" and "selectively," when modifying an action, movement, configuration, or other activity of one or more components or characteristics of an apparatus, mean that the specific action, movement, configuration, or other activity is a direct or indirect result of user manipulation of an aspect of, or one or more components of, the apparatus.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It also is within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

The various disclosed elements of apparatuses and steps of methods disclosed herein are not required to all apparatuses and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein, and such inventive subject matter may find utility in apparatuses and/or methods that are not expressly disclosed herein.

The invention claimed is:

1. A firearm cartridge primer removal tool, comprising:

a base configured to support a plurality of spent firearm cartridge casings; and a plurality of primer removal pins supported relative to the base and configured to be operatively translated toward, into engagement with, and to remove primers from spent firearm cartridge casings supported by the base, wherein the plurality of primer removal pins each include a distal tip configured to operatively engage primers from spent firearm cartridge casings supported by the base, wherein the distal tips are unevenly spaced relative to the base, wherein the plurality of primer removal pins includes at least a first subset with distal tips spaced a first distance away from the base and a second subset with distal tips spaced a second distance away from the base, and wherein the second distance is different from the first distance.

2. The tool of claim 1, further comprising:

at least one tray configured to receive a plurality of spent firearm cartridge casings, wherein the at least one tray is configured to be selectively positioned relative to the base for operative alignment of spent firearm cartridge casings received by the tray with the plurality of primer removal pins.

3. The tool of claim 2, wherein the at least one tray includes a first tray configured to receive a plurality of spent firearm casings of a first caliber and a second tray configured to receive a plurality of spent firearm casings of a second caliber that is different from the first caliber.

4. The tool of claim 3, wherein the plurality of primer removal pins are fixed relative to each other and are configured to operatively remove primers from spent firearm cartridge casings supported by the first tray positioned relative to the base and to operatively remove primers from spent firearm cartridge casings supported by the second tray positioned relative to the base.

5. The tool of claim 2, wherein the at least one tray defines a plurality of bores sized to securely receive a plurality of spent firearm cartridge casings, wherein each bore has a longitudinal axis generally aligned with a longitudinal axis of a corresponding primer removal pin of the plurality of primer removal pins when the tray is operatively positioned relative to the base; and wherein each bore has an upper depth with a first diameter corresponding to an outer diameter of a firearm cartridge casing and a lower depth with a second diameter that is smaller than the first diameter and greater than a diameter of an associated primer to be removed from the firearm cartridge casing.

6. The tool of claim 2, wherein the base defines a primer receipt region positioned to receive primers from spent firearm cartridge casings removed by the plurality of primer removal pins; and wherein the base is configured to selectively receive the at least one tray operatively above the primer receipt region.

7. The tool of claim 1, wherein the plurality of primer removal pins are fixed relative to each other.

8. The tool of claim 1, wherein the plurality of primer removal pins includes more than two subsets with distal tips spaced at different distances away from the base.

9. The tool of claim 1, wherein the plurality of primer removal pins are spaced apart and includes at least 2 primer removal pins.

10. The tool of claim 1, further comprising:

an upper frame member, wherein the upper frame member operatively supports the plurality of primer removal pins, and wherein the upper frame member is configured to be selectively translated toward and away from the base; and a support frame that operatively couples the upper frame member to the base.

11. The tool of claim 10, wherein the upper frame member is spring-biased away from the base.

12. The tool of claim 1, further comprising:

an actuator configured to operatively translate the plurality of primer removal pins toward the base for operative removal of primers from spent firearm cartridge casings supported by the base responsive to a single user action.

13. The tool of claim 12, wherein the actuator includes a press.

14. The tool of claim 12, wherein the actuator is configured to be manually operated, and wherein the actuator is configured to be operated with an input of less than 50 lbs of force from a user.

15. The tool of claim 1, wherein the plurality of primer removal pins are configured to remove primers from spent firearm cartridge casings of more than one caliber.

16. The tool of claim 1, further comprising:

a casing retention structure positioned above the base, wherein the casing retention structure is configured to permit the plurality of primer removal pins to pass through the casing retention structure while preventing spent firearm cartridge casings from passing through the casing retention structure.

17. The tool of claim 16, wherein the casing retention structure includes one or more of a mesh, a net, a grid, and a plate with bores having passages aligned with longitudinal axes of the plurality of primer removal pins.

18. A firearm cartridge primer removal tool, comprising:

a base configured to support a plurality of spent firearm cartridge casings;

a plurality of primer removal pins supported relative to the base and configured to be operatively translated toward and into engagement with and to remove primers from spent firearm cartridge casings supported by the base, wherein the plurality of primer removal pins each include a distal tip configured to operatively engage primers from spent firearm cartridge casings supported by the base, and wherein the distal tips are unevenly spaced relative to the base, wherein the plurality of primer removal pins includes at least a first subset with distal tips spaced a first distance away from the base and a second subset with distal tips spaced a second distance away from the base, wherein the second distance is different from the first distance;

an upper frame member, wherein the upper frame member operatively supports the plurality of primer removal pins, and wherein the upper frame member is configured to be selectively translated toward and away from the base and is spring-biased away from the base;

a support frame that operatively couples the upper frame member to the base; and at least one tray configured to receive a plurality of spent firearm cartridge casings, wherein the at least one tray is configured to be selectively positioned relative to the base for operative alignment of spent firearm cartridge casings received by the tray with the plurality of primer removal pins, wherein the at least one tray defines a plurality of bores sized to securely receive a plurality of spent firearm cartridge casings, wherein each bore has a longitudinal axis generally aligned with a longitudinal axis of a corresponding primer removal pin of the plurality of primer removal pins when the tray is operatively positioned relative to the base, wherein each bore has an upper depth with a first diameter corresponding to an outer diameter of a firearm cartridge casing and a lower depth with a second diameter that is smaller than the first diameter and greater than a diameter of an associated primer to be removed from the firearm cartridge casing.

19. A firearm cartridge primer removal tool, comprising:

means for receiving a plurality of spent firearm cartridge casings; and a plurality of primer removal pins for simultaneously removing primers from spent firearm cartridge casings supported by the means for receiving; and wherein the plurality of primer removal pins each include a distal tip configured to operatively engage primers from spent firearm cartridge casings supported by the means for receiving, wherein the distal tips are unevenly spaced relative to the means for receiving, wherein the plurality of primer removal pins includes at least a first subset with distal tips spaced a first distance away from the means for receiving and a second subset with distal tips spaced a second distance away from the means for receiving, and wherein the second distance is different from the first distance.

* * * * *